US005662204A

United States Patent [19]

Menke et al.

[11] Patent Number: 5,662,204

[45] Date of Patent: Sep. 2, 1997

[54] MONEY OPERATED GAMING MACHINE

[75] Inventors: Wilhelm Menke; Börge Heidersberger, both of Bingen/Rhein, Germany

[73] Assignee: NSM Aktiengesellschaft, Germany

[21] Appl. No.: 481,523

[22] PCT Filed: Sep. 14, 1994

[86] PCT No.: PCT/EP94/03080

§ 371 Date: Aug. 4, 1995

§ 102(e) Date: Aug. 4, 1995

[87] PCT Pub. No.: WO95/13598

PCT Pub. Date: May 18, 1995

[30] Foreign Application Priority Data

Nov. 11, 1993 [DE] Germany ..... 43 38 611.3

[51] Int. Cl.[6] ..... G07F 17/32

[52] U.S. Cl. ..... 194/215; 221/281

[58] Field of Search ..... 194/215, 216, 194/217, 218; 453/17, 20, 21, 40, 41; 221/281; 312/322

[56] References Cited

U.S. PATENT DOCUMENTS

| | | | |
|---|---|---|---|
| 3,339,995 | 9/1967 | Bencene | 312/322 |
| 4,374,557 | 2/1983 | Sugimoto et al. | 194/215 |

FOREIGN PATENT DOCUMENTS

| | | |
|---|---|---|
| 0312386 | 4/1989 | European Pat. Off. . |
| 1259985 | 2/1968 | Germany . |
| 2530441 | 1/1977 | Germany . |
| 3727927 | 3/1989 | Germany . |
| 829664 | 3/1960 | United Kingdom . |

*Primary Examiner*—F. J. Bartuska

*Attorney, Agent, or Firm*—Ostrolenk, Faber, Gerb & Soffen, LLP

[57] ABSTRACT

A money operated gaming machine has a box-like housing and a door pivoted on one side wall and able to be locked to such housing, such door bearing on an outer side thereof game areas and a design characterizing the game. In the housing there is arranged a coin unit which consists at least of a coin inlet, a coin testing mechanism, coin distributing and guiding mechanism coin stack tubes and a coin paying out mechanism. At the side wall of the housing, located on the opening side of the door, rails are attached for a carriage holding a frame, which is provided with holding mechanisms for the individual modules constituted by the components of the coin unit. To facilitate simpler and clear installation and maintenance of the coin unit, at the inner side of the back wall of the frame a printed circuit board with U-shaped and knife-like limbs constituting contacts is held, which on insertion into the frame of a module provided with contact springs come into conducting contact with the contact springs.

27 Claims, 14 Drawing Sheets

FIG.2
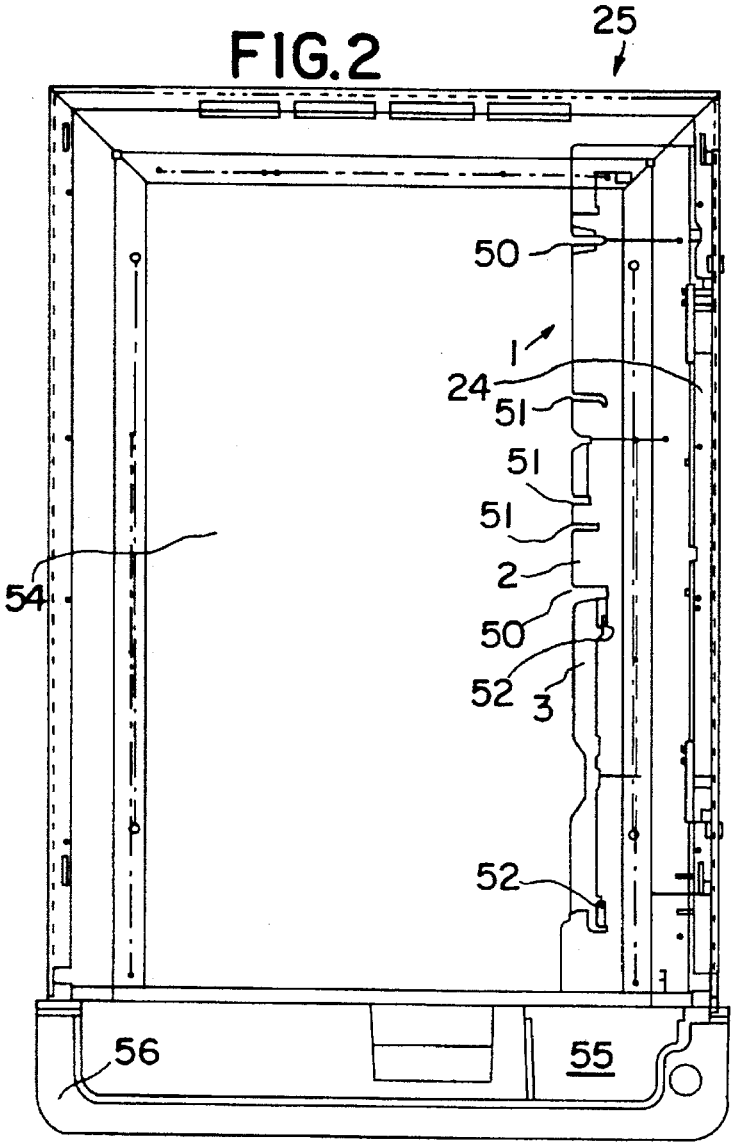
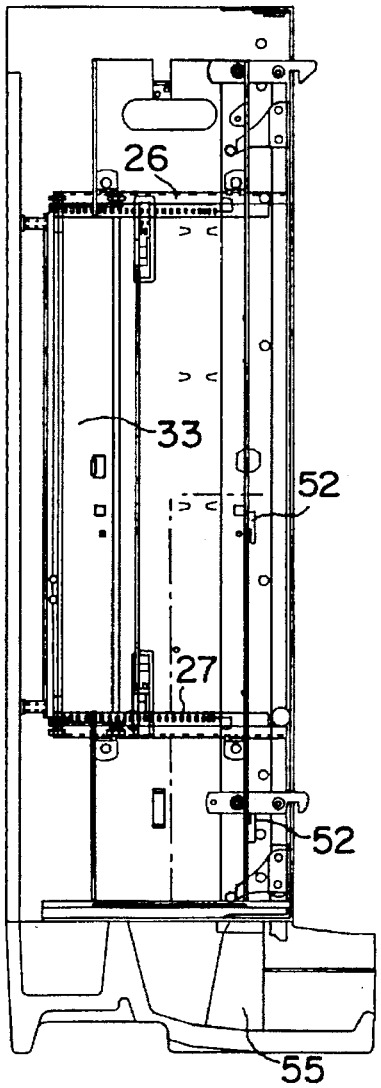
FIG.3
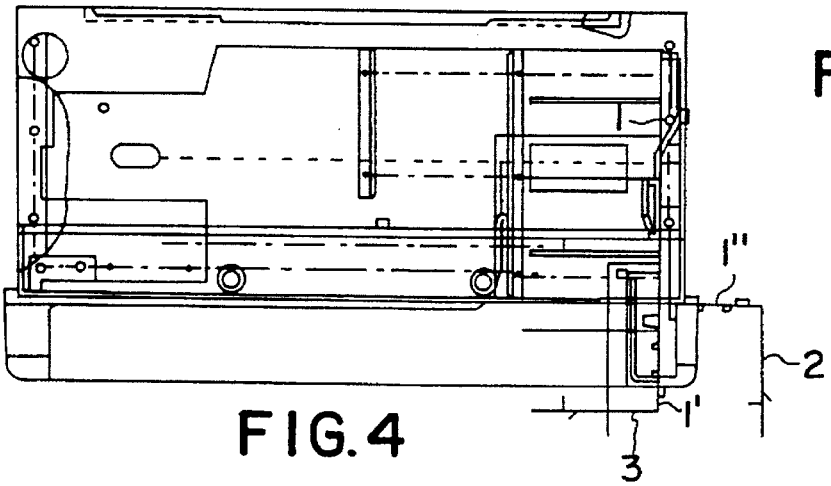
FIG.4

FIG. 15
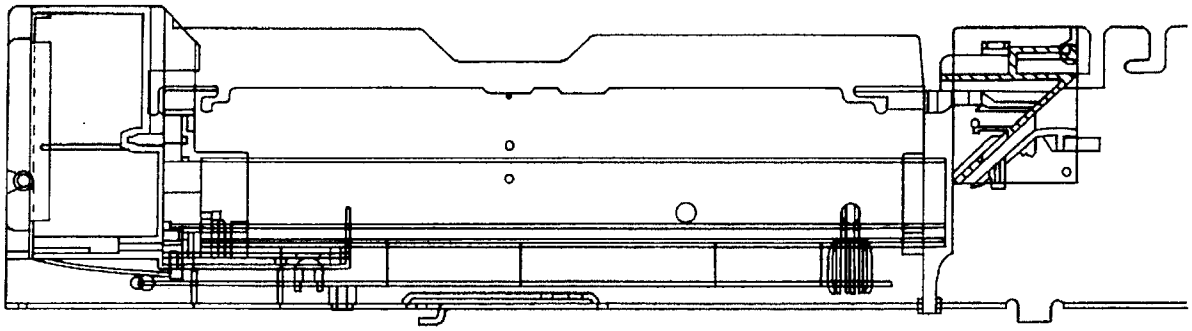
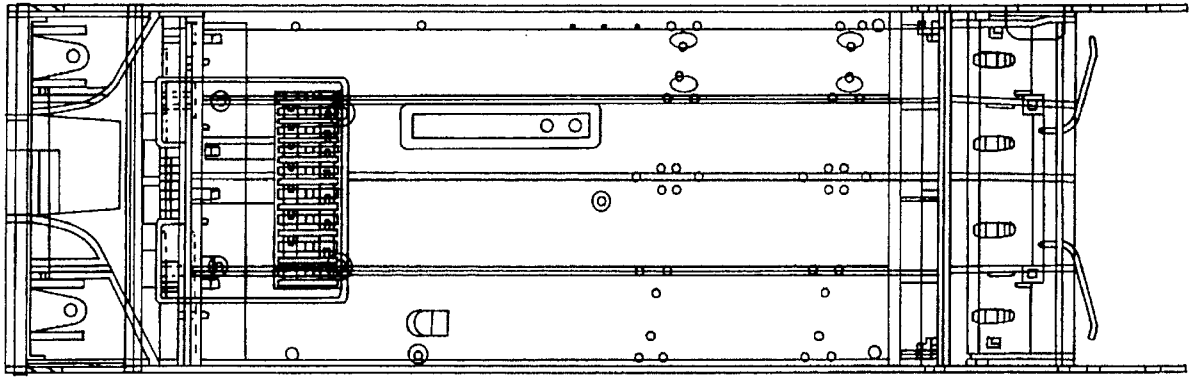
FIG. 16
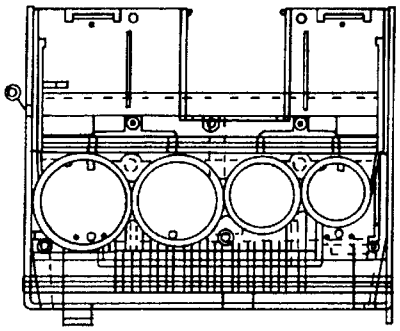
FIG. 17

MONEY OPERATED GAMING MACHINE

The invention relates to a money operated gaming machine comprising a box-like housing, a door pivoted on one side wall and able to be locked to same, such door bearing on an outer side thereof game areas and a design characterizing the game, a coin unit, arranged in the housing, and provided at least with a coin inlet, with a coin tester, with a coin distribution and guiding means, with coin stack tubes and with a coin counting and paying out means, rails attached to the side wall, located on the opening side of the door, of the housing, a carriage adapted to run on such rails, a frame held by such carriage, and holding means provided on such carriage for the individual modules constituted by the components of the coin unit.

Coin operated gaming machines are provided with guide devices for coins inserted in the coin slot to supply the coins to coin testing means, to stack the coins recognized as being genuine in coin stack tubes of a coin pay out means, to pass coin rejected by the coin stacking tubes when same overflows to a coin collecting container, to pass unidentified coins to a return plate and, in accordance with acknowledged winnings or with a demand made by the player, to cause coins to be paid out. Coin units for money operated gaming machines with the initially mentioned components must be compact in design in accordance with the desire for a small overall size and furthermore must be robust and tamperproof. Furthermore as a result of the requirement for rational and low-price production and servicing it is desirable for the coin units to be simply and rapidly installed in a straightforward fashion in the money operated gaming machine, the individual components being readily accessible for the purpose of servicing and, if required, replacement, substitution thereof also being easy to perform.

One object of the invention is therefore to provide a money operated gaming machine of the type initially mentioned whose coin unit can be installed in the machine in a simple and straightforward fashion and after installation may be serviced in a simple manner because the individual components of the coin unit are readily accessible and readily replaced.

In accordance with the invention this object is to be achieved in the case of a money operated gaming machine of the type initially mentioned because on the inner side of the back wall of the frame a printed circuit board with U-like and knife-like limbs constituting electrical contacts is held, which on insertion into the frame of a module provided with electrical contact springs come into electrical contact with such contact springs.

In the case of the money operated gaming machine in accordance with the invention the individual components of the coin unit are arranged in a modular manner in a frame, which is held on a carriage so that such frame may be slid into the housing and for the sake of better accessibility may be furthermore be retracted from it. The individual components consist of modules, which in a manner similar to a modular set of parts, may be inserted in the frame and in a like fashion may be retracted therefrom. In this respect the holding means of the individual modules in the frame are so designed that same when inserted are necessarily located in their functional, cooperating position and the modules when completely inserted in the frame represent the operative coin unit. The possibility of easy assembly and of accessibility is ensured because the carriage, which holds the frame, may be drawn out and pushed back into place.

The individual modules may include sensors, control devices, circuitry and drives and the like, which must be supplied with electrical power or must be connected with electrical contacts of a printed circuit board secured to the frame. There is consequently an additional requirement for simple and rapid production of the corresponding electrical connections between the modules and the electrical contacts of a printed circuit board or the like. In accordance with a further development of the invention there is hence a provision such that on the inner side of the bridge part of the frame a printed circuit board with U-like and knife-like limbs constituting electrical contacts is held, which on replacement of a module provided with electrical contacts in the frame come into electrical contact with such contact springs. Preferably the module comprising the paying out means and the coin stacking tubes is provided with electrical contact springs. The U-like limbs and the electrical contact springs are preferably arranged in a row. The electrical contact springs are preferably in the form of pre-tensioned tension springs.

in accordance with a particular development of the invention, for which sub-combination protection is claimed, two mutually parallel rails are provided which are provided with racks or rows of holes, into which the teeth of two gear wheels mounted on a common synchronizing shaft rotatably carried in the carriage fit. This design in accordance with the invention means that removal and insertion of the carriage bearing the frame is possible without skew running.

Preferably the rails possess a U-like cross section, same being mounted with their limbs directed toward each other, the rows of holes being arranged in the limbs facing the side wall of the housing. For low-friction running of the same it is possible for respectively two rollers to be rotatably mounted to fit between the limbs of each rail. Preferably the carriage is borne by means of wheel or caster on the outer limbs of the lower rail. Since the carriage is guided without any possibility of running skew, a single wheel is sufficient for carrying it.

An other advantageous feature of the invention is such that the carriage is provided with two aligned, projecting pins parallel to its outer edge, into which pins the bearing eyes of the frame may be inserted. This design renders possible pivoting of the frame, in addition to outward movement thereof, into a position in which accessibility is improved.

It is convenient if the frame comprises a U-like, bent sheet metal cutout, the bearing eyes being located on the outer side of the bridge part with a lateral spacing from the limbs constituting the side parts. Owing to this design it is possible to ensure that the frame is only able to be pivoted outward, when it has been so far drawn out from the housing that its front edge no longer abuts the side wall or, respectively, the guide rails. If on the contrary the carriage is moved further back into the housing, the bridge parts located on each side of the joint, of the frame will bear on the guide so that the frame is held in the inserted position without being able to pivot.

In accordance with a further development of the invention, for which sub-combination protection is claimed, there is a provision such that on the side wall of the housing mutually parallel levers, which possess hooks, are mounted in a pivotal manner, which levers are pivotally joined together in a pivoting manner by means of a connecting rod constituting a coupling link, such levers forming the locking means for the door. Since the locking hooks may project past the side wall of the housing, the floor or, respectively, the bridge part of the frame is preferably provided with corresponding window-like openings so that in the event of pivoting of the frame in the drawn out state the hooks may fit into such window-like openings. In this respect it is possible for the hooks to be additionally fitted around the edges of the bridge part of the frame so that the same is held in a releasable manner in its drawn out and outwardly pivoted setting.

It is convenient if the four link system consisting of the two levers and the connecting rod is acted upon by a spring urging the same toward the locked position.

A furthermore development of the invention provides that the connecting rod possesses locking members, provided with oblique surfaces, for the frame in its inserted setting.

In order to be able to open the housing door, it is possible to provide a separate lock so that the connecting rod is able to be lifted for unlocking the door using a key.

An other advantageous feature of the invention is such that the modules are provided with side pins, which are able to be inserted into slot-like of bayonet-like guides in the side edges of the side parts of the frame. It is in this manner that it becomes possible for the modules to be inserted and releasably locked simply by lifting, sliding and/or pivoting in holding means of the frame. Additionally it is possible for snap-action ratchet means to be provided, which may be released again by depressing resilient ratchet parts.

In accordance with an advantageous development of the invention there is a provision such that on its upper or lower surface at least one module possesses springs, for example in the form of strip springs, acting on the module underneath it or above it. It is in this manner that the respective module may be released from the its holding or ratchet action by pressing against the spring force so that the modules underneath or above it may be accessed.

Modules which are spring loaded in the manner described may be provided both with detent projections or detent spurs for modules which are underneath or above same.

The individual modules may possess sensors, control means, circuits and drives, which must supplied with current or have to be connected with the electrical contacts of a printed circuit board secured to the frame. There is consequently an additional need as regards being able to simply and rapidly produce the corresponding electrical connection between the modules and electrical contacts on a printed circuit board or the like. In accordance with a further development of the invention there is consequently a provision such that on the inner side of the bridge part of the frame a printed circuit board is provided which has knife-like U-like limbs constituting electrical contacts, which limbs on insertion of a module bearing electrical contact springs into the frame come into electrical contact with such electrical contact springs. It is convenient if the module comprising the pay out means and the coin stack tubes is provided with electrical contact springs. The ulike limbs and the electrical contact springs are preferably arranged on one row. The electrical U-like contact springs are preferably manufactured in the form of pre-tensioned tension springs.

One working embodiment of the invention will now be described with reference to the drawing.

FIG. 2 shows a front elevation of the housing of the money operated gaming machine after removal of the door and with the frame moved into the housing, in which no modules of the coin unit are held.

FIG. 3 is a plan view of the side wall, holding the frame, with the carriage and the carriage guide means.

FIG. 4 is a cross section taken through the housing in accordance with FIGS. 2 and 3.

FIG. 15 is a lateral elevation of the lower part of the frame with modules, held therein, of the coin passage, of the coin stack tubes and of the coin pay out means.

FIG. 16 is a front elevation of the frame part in accordance with FIG. 15.

FIG. 17 is section taken through the frame of FIG. 16.

Figure 1:
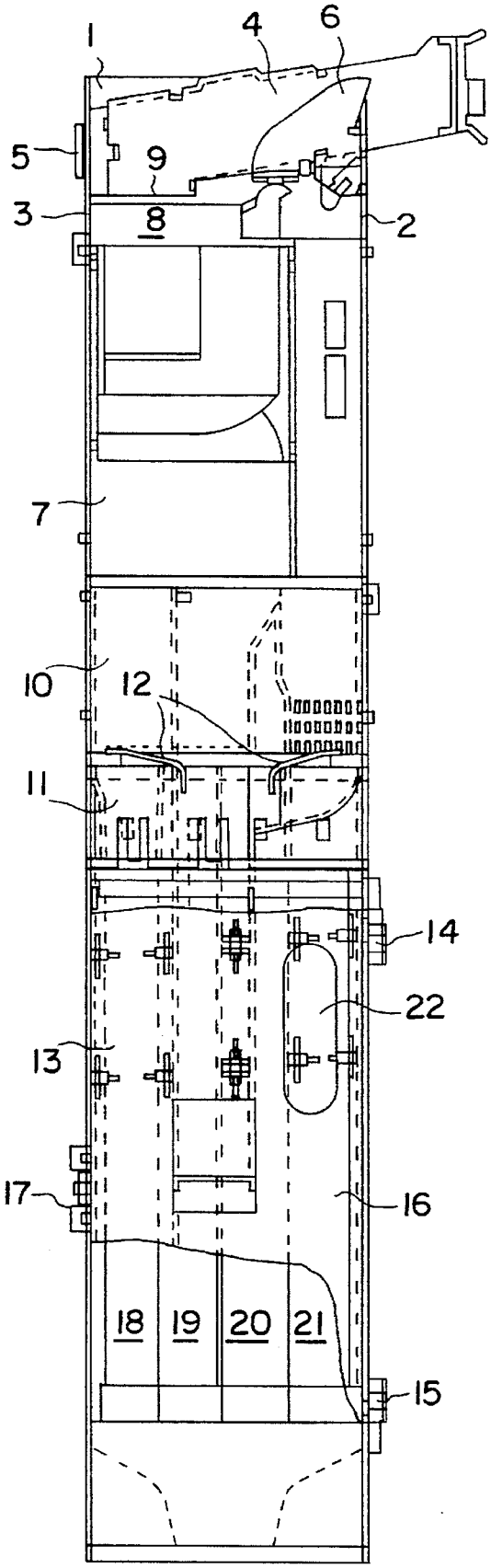
FIG. 1 is a front elevation of the modules of the coin unit mounted in a frame.
Figure 5:
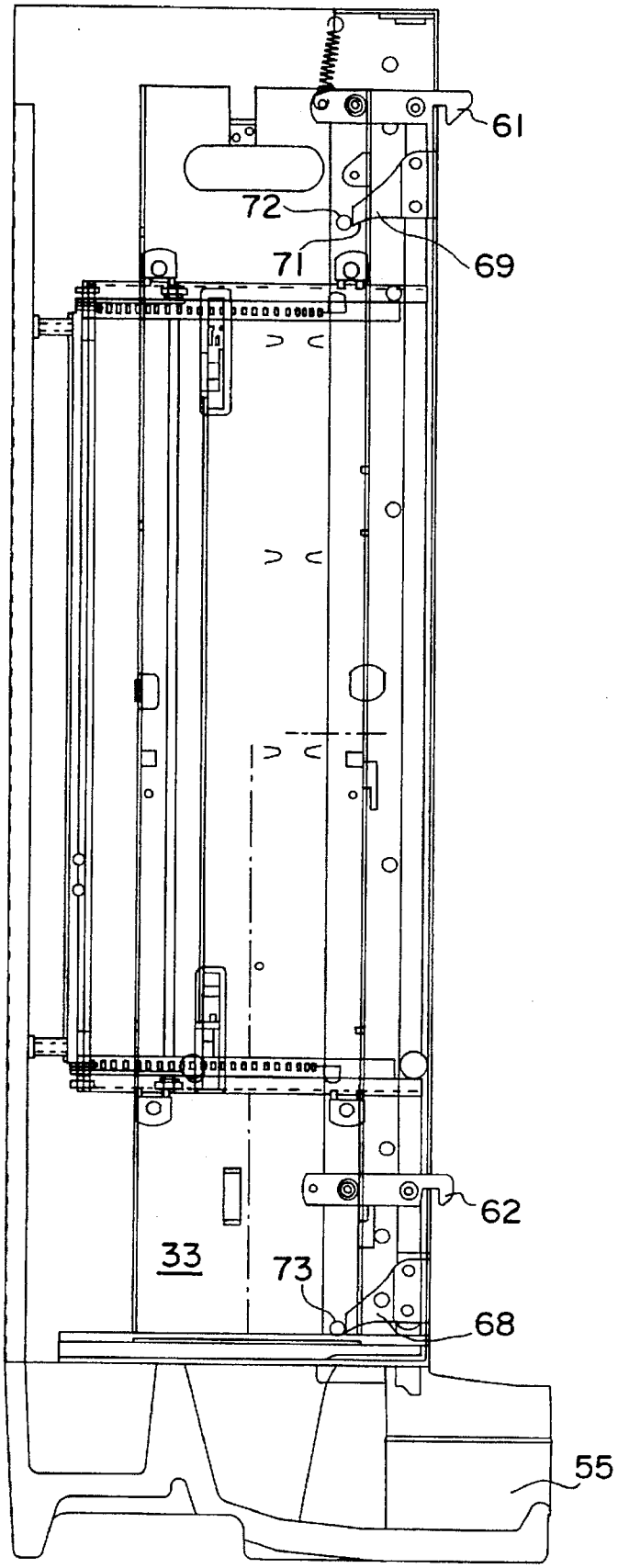
FIG. 5 is view of the structure of FIG. 3 on a larger scale.

In FIG. 1 the reader will see a frame 1 with a U-like cross section, in which the modules constituting the individual components of the coin unit are mounted.

At the upper end of the frame 1 in its sheet metal side plates constituted by the angled limbs the coin inlet tube member 4 is mounted which forms the coin inlet channel and which is generally rectangular in cross section. Said member has at its front end a tongue 5, which is mounted and held by fitting into a corresponding slot in the side part 3. In its middle part the coin inlet tube member 4 possesses a hook 6 with an obliquely set front edge, with which the same may be locked in a corresponding recess in the side part 2. For removal of the coin inlet tube member 4 the hook only has to be pivoted by hand so that the tongue 5 is able to be removed from the holding slot in the side wall 3.

Underneath the coin inlet the module 7 is held which constitutes the coin tester. In order to hold the module in place same is provided with side pins, which are able to be inserted in corresponding guides or, respectively, bayonet like guides in the side parts 2 and 3 in the frame. The module 7 is so held in the frame 1 in its inserted and locked position that its inlet slot 8 is below the outlet slot 9 of the coin inlet tube member 4.

Underneath the module 7 in the side system 2 and 3 a module 10 is held, which is provided with channels for passing on the coins sorted by the module 7. Underneath the module 10 there is a module 11 constituting a coin passage. Same is as well provided with pins for holding it in the upper position in the side parts 2 and 3. The module is provided on its top surface with two strip springs 12, which tend to move the module 10 in an upward direction.

Underneath the module 11 the module 13 is held in the side parts 2 and 3; it contains the coin stack tubes and the coin pay out means. The coin pay out unit or means is provided with outlet openings, which pass on the coins, which are due to be paid out, to a guide extending to the issuing plate.

At a position adjacent to the module 13 a flap 16 is mounted by hinges 14 and 15 on the side part 5, the opposite end of the flap 16 being able to be locked by means of a spring locking means 17 on the side part 3. The flap 16 covers the coin stack tubes 18 through 21 so that unauthorized persons may not directly see how full the tubes are. Furthermore the flap 16 is provided with a handle cutout 22, into which the fingers of a person having to do with the device may be introduced in order to retract the frame from the housing and to pivot it.

FIG. 2 shows a front elevation of the housing consisting of a low box, the front door having been removed from it. On the inner side of the right hand side wall 24 of the housing 25 the guide rails 26 and 27 for the moving carriage 28 are secured in it. The guide rails and the carriage are best to be seen in FIGS. 6 through 8. The guide rails 26 and 27 consist of U girders, whose longer limbs 28 and 29 are attached by means of angle brackets on the side wall 24 of the housing. The longer limbs 28 and 29 are provided with rows 31 of holes or indexing formations, which are engaged by cooperating indexing formations constituted by the teeth that protrude from gear wheels 32 mounted on a synchronizing shaft 34 carried in the carriage 33. The synchronizing shaft 34 bears rollers 35 at its pins extending past the gear wheels 32, such rollers running between the limbs of the sections 26 and 27. In the carriage 33 which is constituted by a housing of generally rectangular cross section, a further shaft 36 is borne, which is provided with rollers 37 fitting between the limbs of the sections 27 and 28.

At the lower end of the of the carriage 36 a support roller 38 or caster is mounted, which runs on the upper edge of the outer shorter limb 39 of the guide rail 27.

At the end positions of the carriage 33 the shorter limb 39 is provided with rounded recesses, into which the caster 38 may drop to provide a light detent action.

At its front side facing away from the longer limbs, provided with the rows 31 of holes or indexing formations, of the guide rails the housing 33 of the carriage possesses trunnions 40 and 41 which may be employed for connection with the joint eyes of the frame 1.

Figures 6, 7, 8:
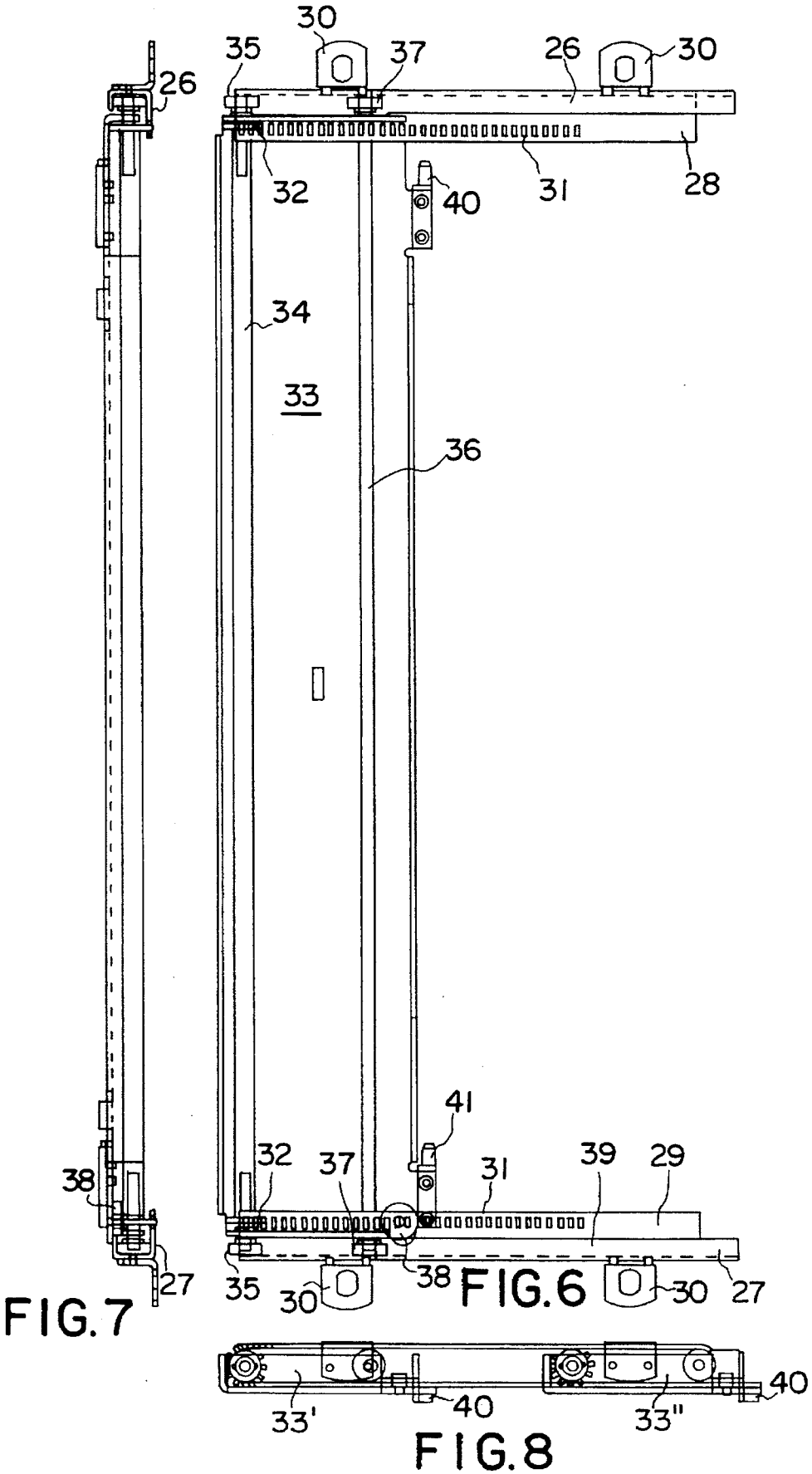
FIG. 6 shows the carriage on a larger scale together with the carriage guide in a front elevation.
FIG. 7 is a view of the structure of FIG. 6 as seen in lateral elevation.
FIG. 8 is a section taken through the carriage with the carriage guide as in FIG. 6.

In FIG. 8 the carriage 33 is represented in a retracted position 33' and in a drawn out position 33".

In FIG. 4 the frame pivotally mounted on the carriage 33 is represented in three different settings, that is to say in its completely drawn in position 1, in its completely extended or drawn out position 1', in which it is not yet pivoted and in its extended position 1" in which it is pivoted through 90° and in which the modules held in it of the coin unit are readily accessible.

Figure 10:
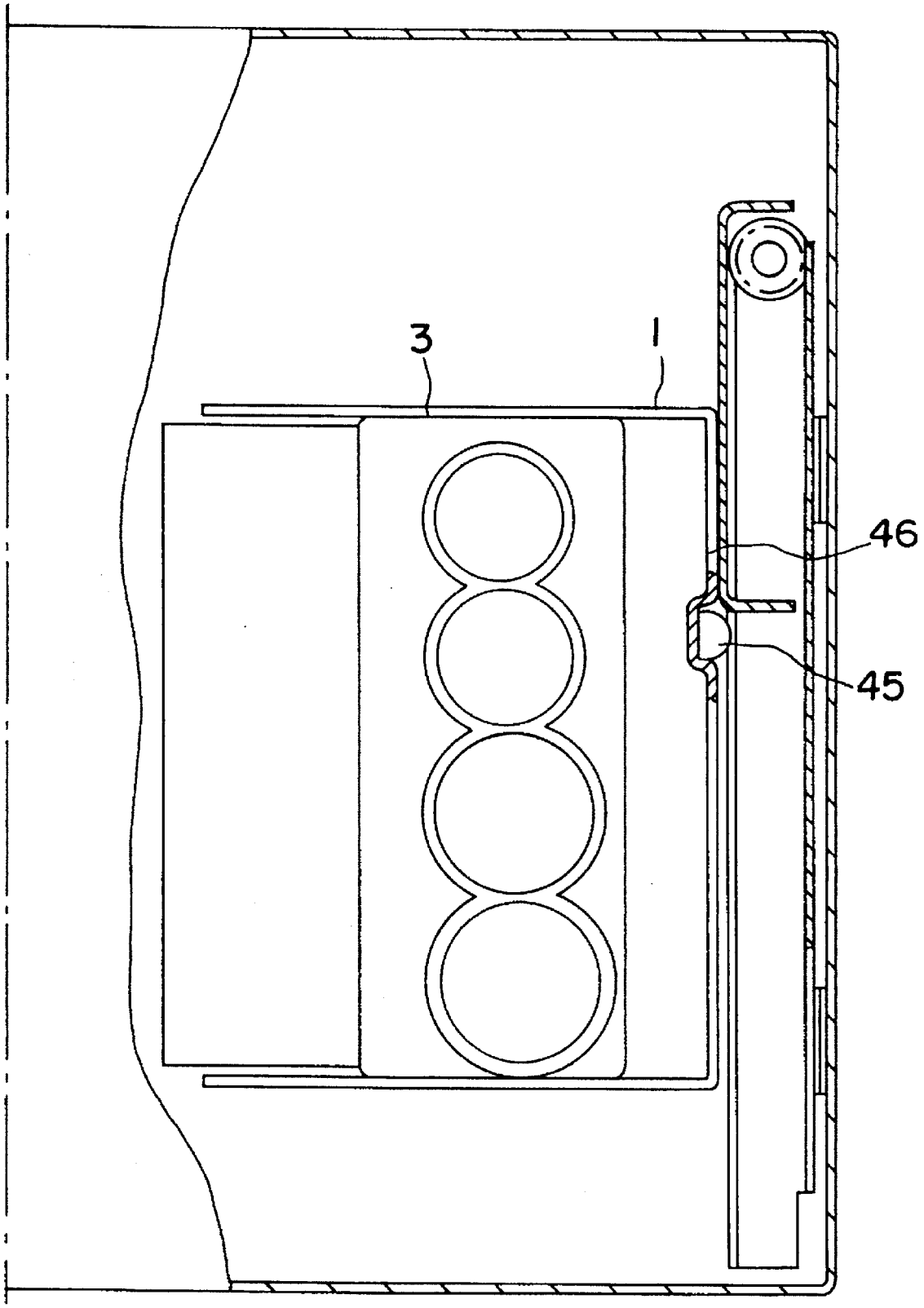
FIG. 10 is a diagrammatic elevation of the frame when inserted in the housing, partially in section.

The completely retracted position of the carriage 1 is diagrammatically represented in FIG. 10. The joint eyes 45 mounted on the trunnions 40 and 41 of the carriage 33, of the frame 1 are located in a pressed groove in the bridge part 46 of the frame 1 at a distance from the inner side part 3 of the frame, which is approximately one third of the width of the bridge part 46. In the drawn in position illustrated in FIG. 10 of the carriage the parts of the bridge part 46, which are one either side of the joints 40, 41 and 45, bear on the guide rails so that the frame is held within the housing without being able to be pivoted.

Figure 11:
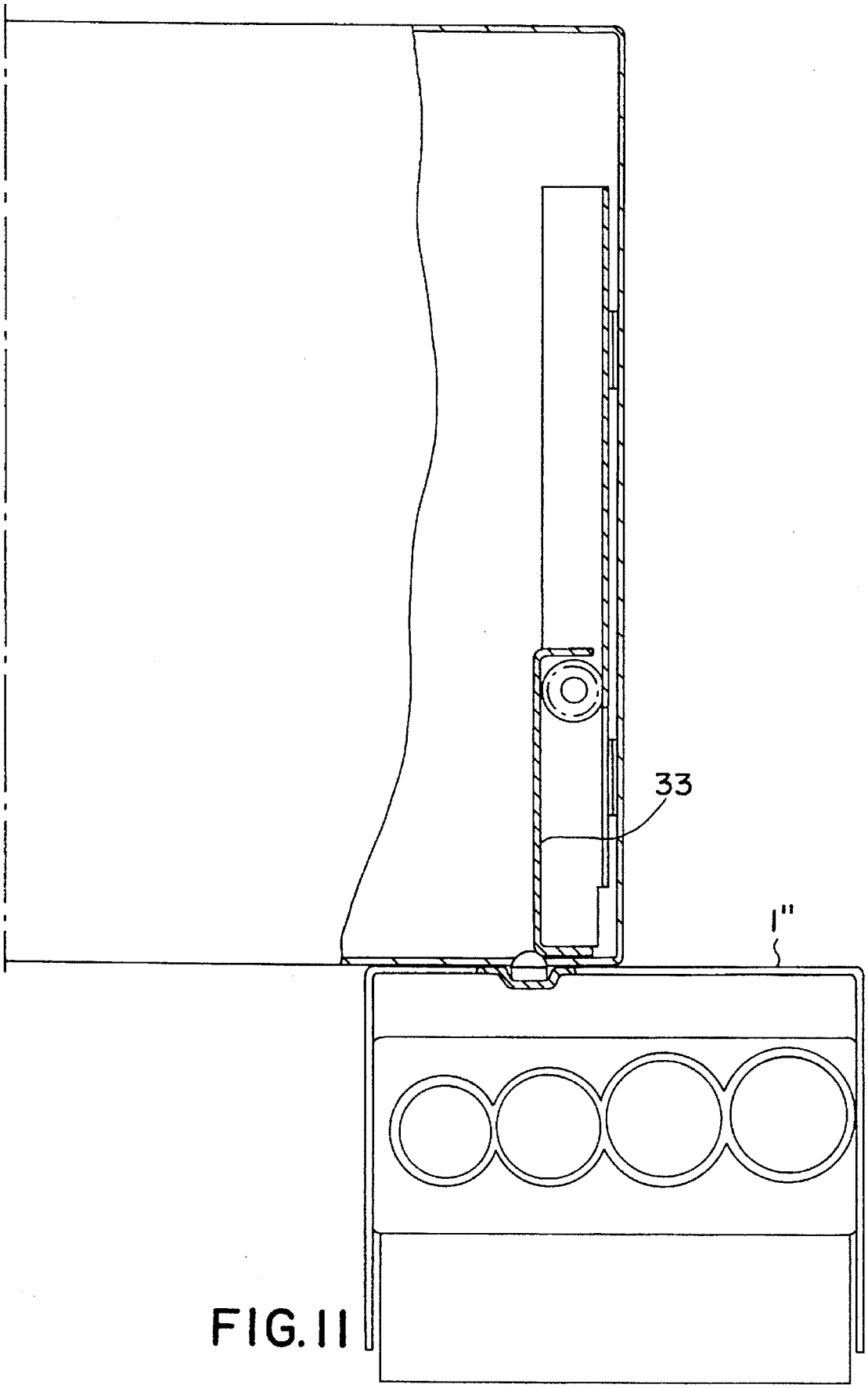
FIG. 11 is a showing, corresponding to FIG. 10, with the frame moved out of the housing and when pivoted outward.

As shown in FIG. 11 it is however possible, while the carriage 33 is in the drawn out position, for the frame to be pivoted through 90° into a position 1", wherein the bridge part of the frame is perpendicular to and in front of the side wall of the housing.

In FIG. 2 the reader will see the frame 1 when retracted into the housing in a side elevation. The edge portions of the side parts 2 and 3 of the frame 1 are provided with open ended slots 50 and with further slots having an inner, bayonet-like curvature 51, which serve for holding lateral pins on the modules inserted into the frame. On this side part 2 pins 52, which point toward one another, are provided which constitute the bearing pins or trunnions for the joints 14 and 15 of the flap 16.

FIGS. 2 and 3 furthermore indicate that a part 56, which comprises the return plate 55, is attached on the lower side of the housing 54.

Figure 9:
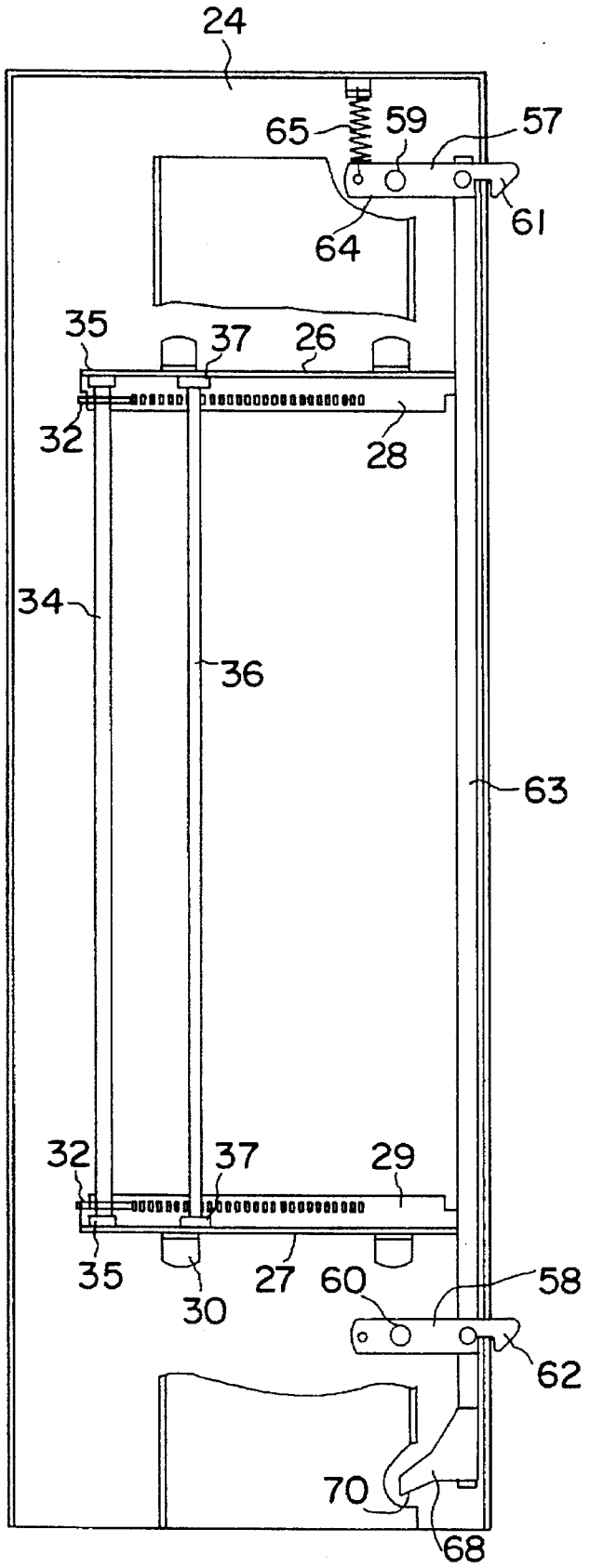
FIG. 9 is representation of the carriage guide omitting the parts which would obscure it in order to render the drawing more straightforward.

As best shown in FIG. 9 on the inner wall surface 24 of the housing 54 two levers 57 and 58 are mounted on pins 59 and 60 for pivotal movement thereon and which at their outwardly directed ends are provided with hooks 61 and 62 projecting past the side wall surface 24. The levers 57 and 58 are connected in an articulating fashion with a coupling link 63, which extends in parallelism to the edge of the side wall 4 and connects the levers 57 and 58 so with one another that the same will remain parallel to each other in every position of pivoting. The coupling link 63, together with the levers 57 and 58, consequently constitutes a four membered articulating system. The lever 57 is provided with a lever arm 64 extending past the joint pin 59, an outer end of the same being connected with a tension spring 65, whose other end is attached to the housing. The spring 65 accordingly loads the hooks 61 and 62 toward the lower side of the housing. The hooks 61 and 62 constitute the locking means for the door (not illustrated) hinged on the opposite side wall of the housing. For opening the door the coupling loop 63 may be lifted using a key and a lock, not illustrated either.

At its upper and lower ends the coupling link possesses angled extensions 68 and 69, whose lower edges 70 and 71 are made oblique. On the carriage 33 side pins 72 and 73 are attached, which during inward motion of the carriage 33 into the housing slide along the oblique surfaces 70 and 71 of the extensions 68 and 69 and accordingly lift the coupling link 67 until the front end surfaces of the extensions 68 and 69 lockingly fit around the pins 72 and 73. In order to release the carriage 33 from its inserted, fixed position the coupling link must be lifted.

Figure 12:
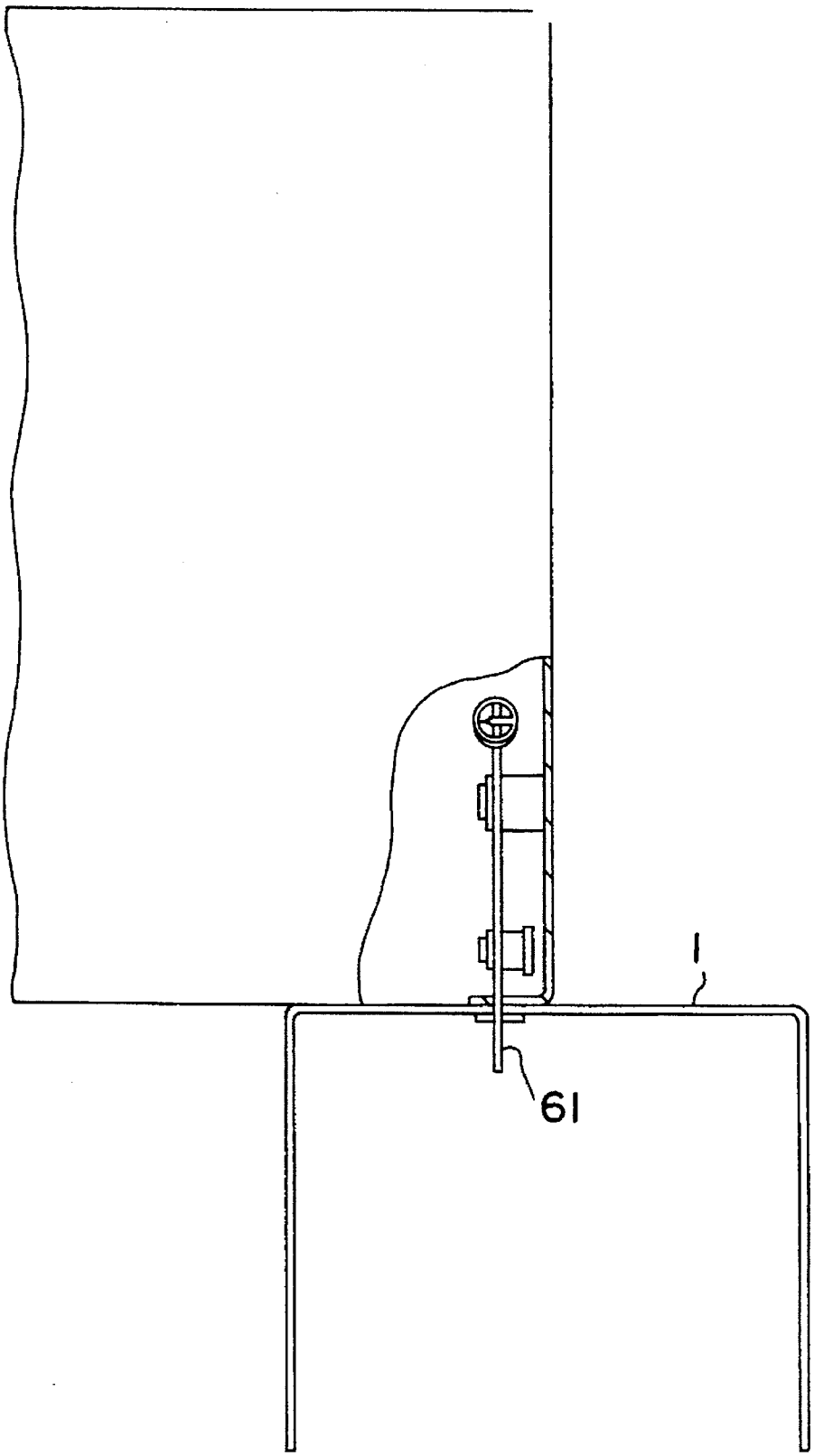
FIG. 12 shows the means for locking the frame in its extended and retracted positions.

In the position indicated in FIGS. 11 and 12 of the frame 1, in which it is extended and pivoted through 90°, the hooks 61 and 62 of the levers 57 and 58 extend through openings provided in the bridge part of the frame 1 and lock, in the manner indicated in FIG. 12, the frame in the drawn out and outwardly pivoted position because the hooks fit around edges of the lower limits of the openings in the bridge part.

Figure 13:
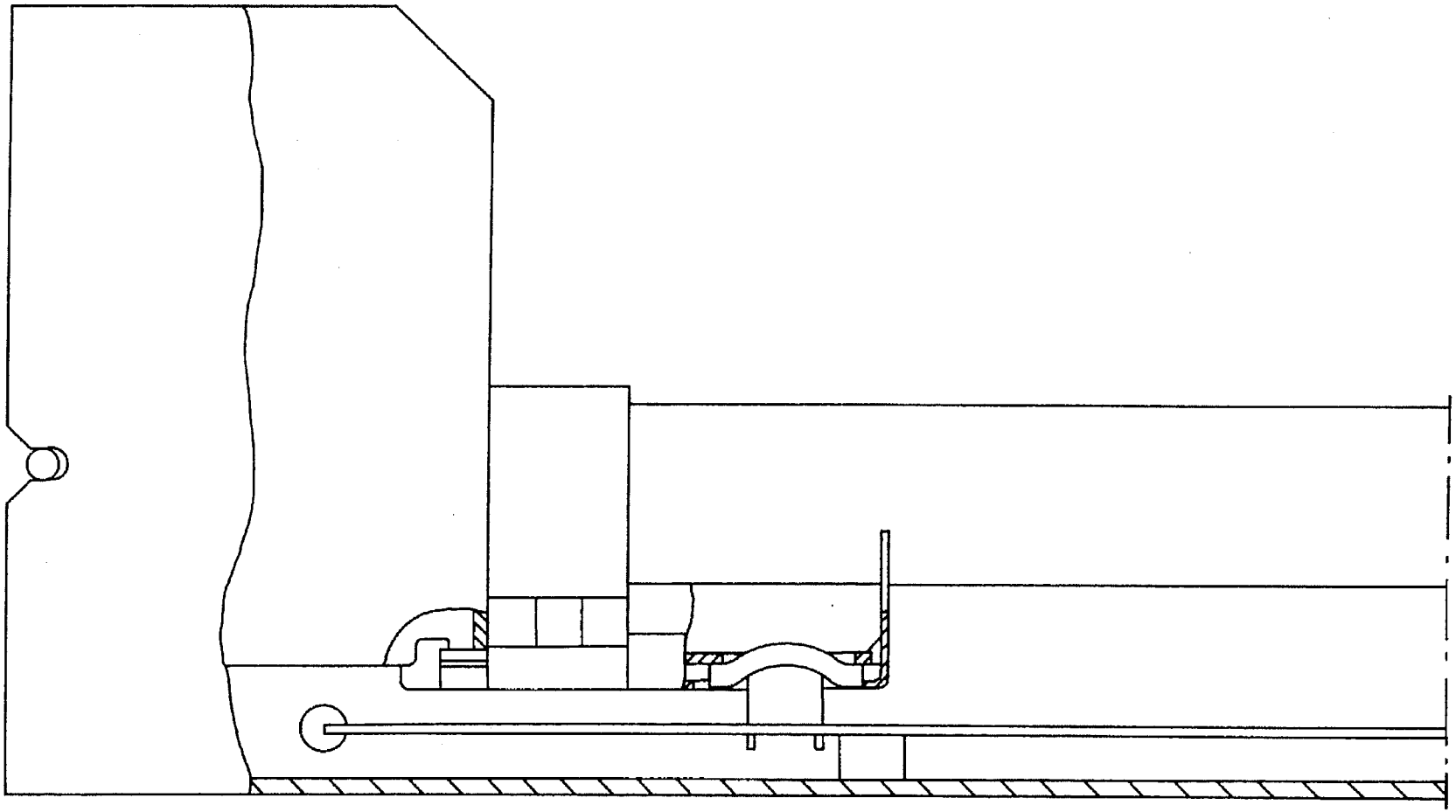
FIG. 13 is a lateral elevation of the module held in the frame and constituted by the coin stacking tubes and the coin pay out means, together with the electrical contact means of the printed circuit board, partially in section.
Figure 14:
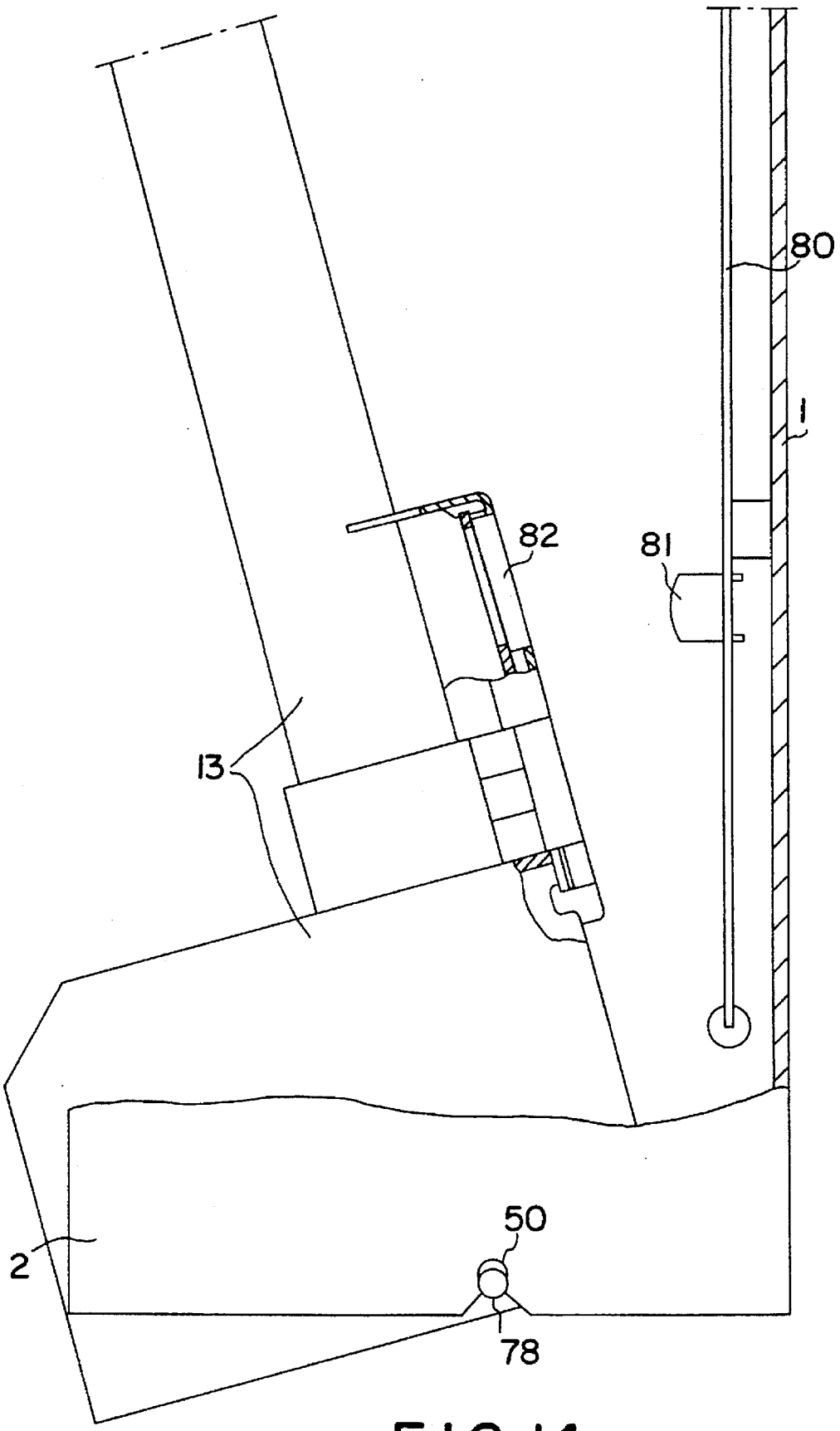
FIG. 14 is a view corresponding to that of FIG. 13 during arrangement in position of the module comprising coin stack tubes and the coin pay out means.
Figure 18:
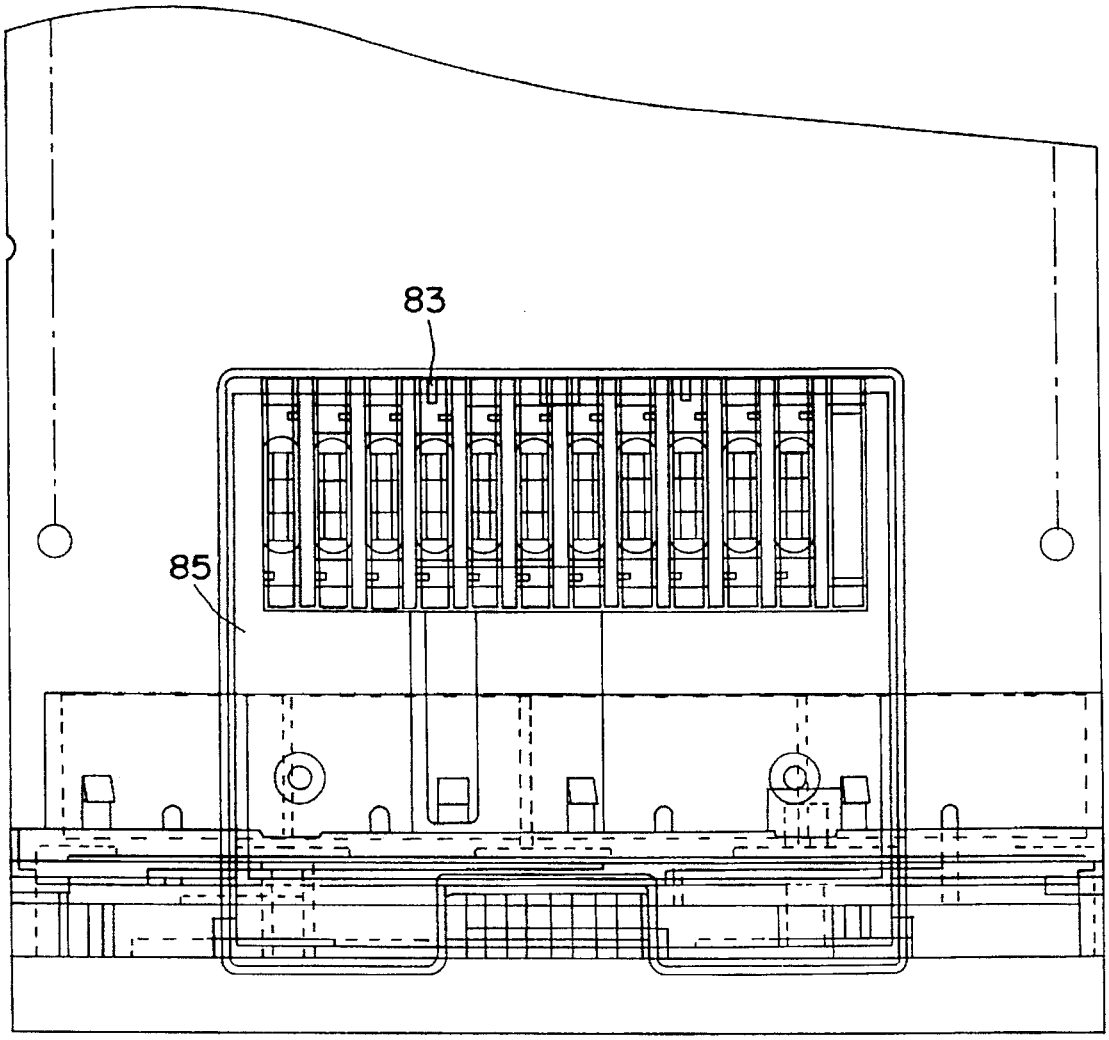
FIG. 18 is rear elevation of the module constituted by the coin stack tubes and the coin pay out means, together with the electrical contact spring arrangement.
Figure 19:
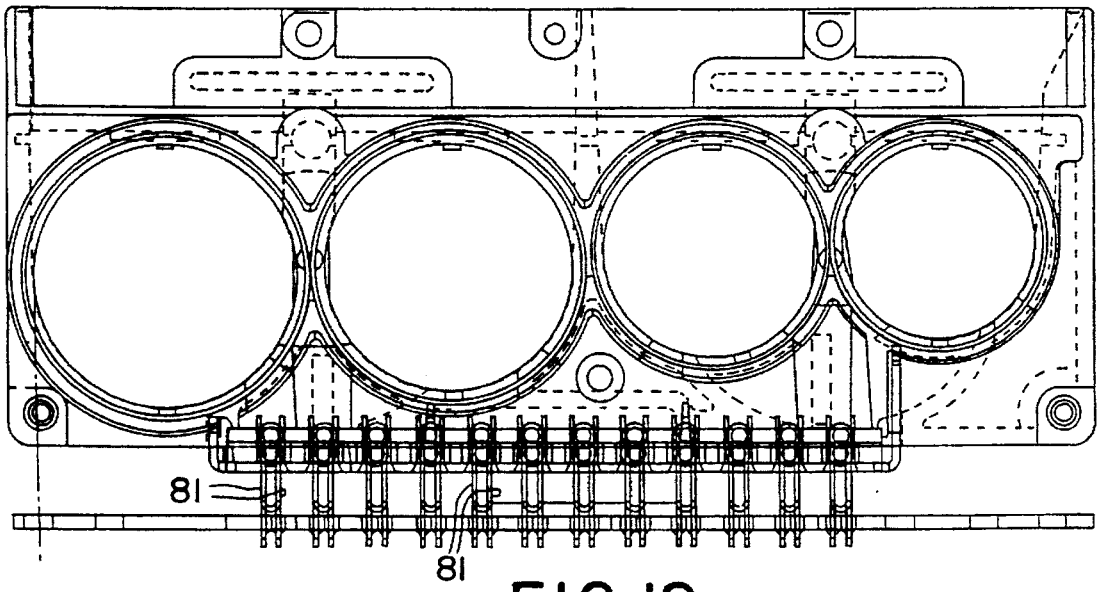
FIG. 19 is a section taken through the structure illustrated in FIG. 18.

In FIGS. 13 and 15 a side elevation of the frame 1 will be seen, which is partially in section; in the lower part thereof the module 13 comprising the coin stack tubes and the coin pay out means is held. For holding same firstly lower side pins 78 of the module 13 are introduced into open ended slots provided in the lower edge of the side parts 2 and 3 and then the module is pivoted about the pins 78 until the upper lateral pins are introduced into the bayonet-like slots in the side parts 2 and 3 and may be snapped into place therein.

Figure 21:
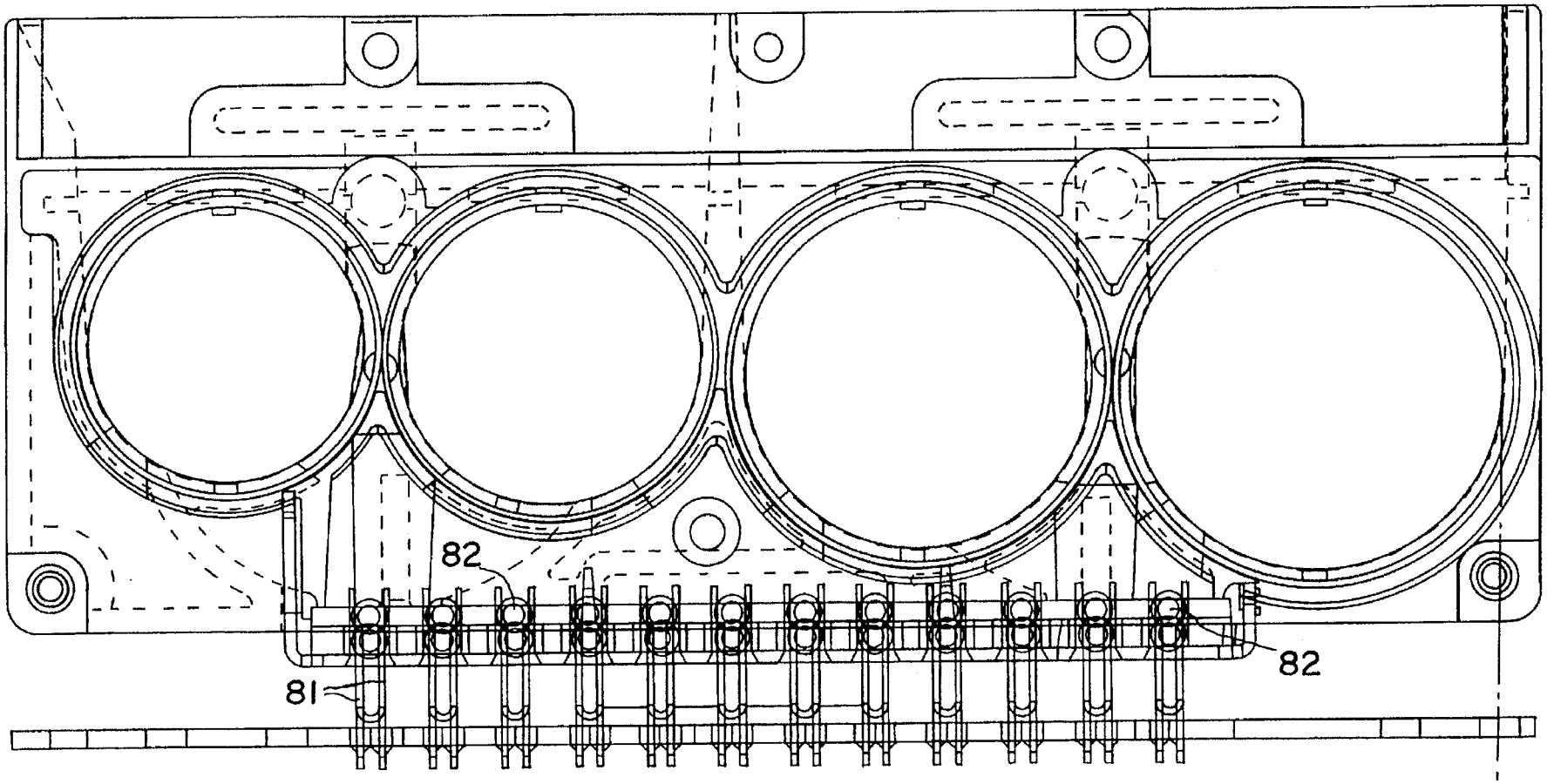
FIG. 21 is a view on a larger scale of the structure shown in FIG. 19.

On the inner side of the bridge part a printed circuit board 80, which if necessary is provided with a protective cover, is secured, which in a row is provided with knife-like edges 81 arranged in pairs adjacent to each other, such edges also being constituted by the limbs of U-like parts if desired. These respectively paired knife-like edges 81 constitute electrical contacts, which on pivoting of the module 13 into its position held or snap-fitted in the frame 1, engage electrical contact springs 82 to form electrical connections. The electrical contact spring 82 are so secured in a plate 83 held on the module 13 that, in the manner indicated in FIG. 21, they may move out of the way toward the coin stack tubes, when they come into contact with the electrical contact edges 81. In the snapped in position of the module the U-like electrical contact edges 81 straddle the contact springs 82 between their limbs so that reliable electrical contact is ensured.

Figure 20:
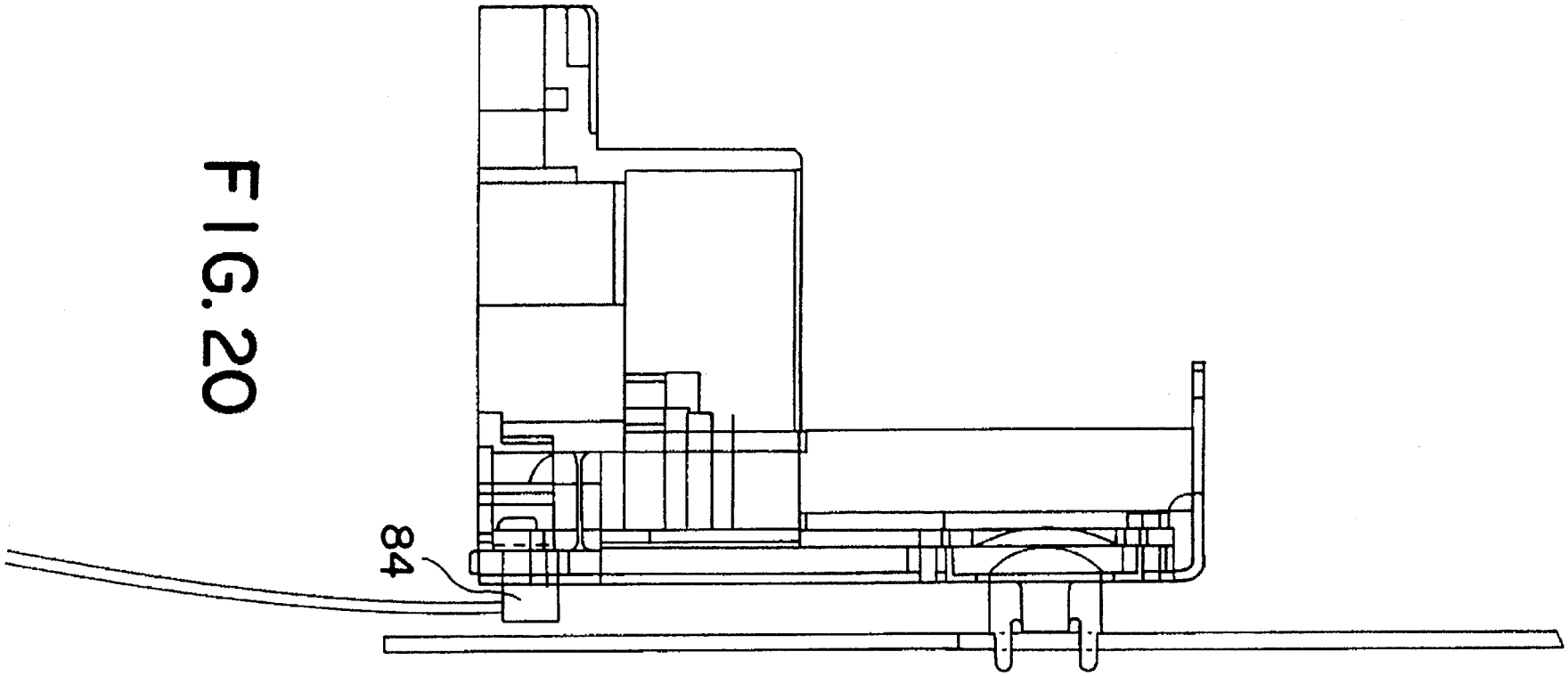
FIG. 20 is a lateral elevation of the structure depicted in FIG. 18.

The entire electrical power supply may be via a plug 84, which in the fashion indicated in FIG. 20 is inserted into electrical contact sockets located in the lower portion of the printed circuit board 85, in which the electrical contact springs 82 are also held.

We claim:

1. A money operated gaming machine comprising a box-like housing, a door pivoted on one side wall and able to be locked to such housing, such door bearing on an outer side thereof game areas and a design characterizing the game, a coin unit, arranged in the housing, and provided at least with a coin inlet, with a coin tester, with a coin distribution and guiding means, with coin stack tubes and with a coin counting and paying out means, rails secured to the side wall, located on the opening side of the door, of the housing, a carriage adapted to run on such rails, a frame held by such carriage, and holding means provided on such carriage for the individual modules constituted by the components of the coin unit, characterized in that on the inner side of the rear wall of the frame (1) a printed circuit board (80) is held having U-like and knife-like limbs (81) constituting electrical contacts, which on insertion of a module (13) provided with electrical contact springs (82) into the frame (1) come into electrical contact with such springs.

2. The money operated gaming machine as claimed in claim 1, characterized in that module (13) containing the pay out means and the coin stack tubes is provided with the electrical contact springs.

3. The money operated gaming machine as claimed in claim 1 or in claim 2, characterized in that the U-like limbs (81) and the electrical contact springs (82) are arranged in a row.

4. The money operated gaming machine as claimed in claim 1 or in claim 2 characterized in that the electrical contact springs (82) are in the form of pre-stressed tension springs.

5. The money operated gaming machine as claimed in claim 1 or in clain 2 characterized in that the modules (7, 10, 11 and 13) are provided with lateral pins, adapted to be inserted into slot-like guides (50 and 51) in the side edges of the side parts (2 and 3) of the frame (1).

6. The money operated gaming machine as claimed in claim 1 or in claim 2, characterized in that at least one module (11) is provided with springs on a side thereof that is adjacent a side of another module (10) that is vertically adjacent said at least one module (11), with said springs loading the another module (10).

7. The money operated gaming machine as claimed in claim 3, characterized in that the electrical contact springs are in the form of prestressed tension springs.

8. The money operated gaming machine as claimed in claim 3, characterized in that the modules are provided with lateral pins, adapted to be inserted into slot-like guides in the side edges of the side parts of the frame.

9. The money operated gaming machine as claimed in claim 3, characterized in that at least one module is provided with springs on a side thereof that is adjacent a side of another module that is vertically adjacent and at least one module, with said springs loading the another module.

10. The money operated gaming machine as claimed in claim 4, characterized in that at least one module is provided with springs on a side thereof that is adjacent a side of another module that is vertically adjacent and at least one module, with said springs loading the another module.

11. The money operated gaming machine as claimed in claim 5, characterized in that at least one module is provided with springs on a side thereof that is adjacent a side of another module that is vertically adjacent and at least one module, with said springs loading the another module.

12. A money operated gaming machine comprising a box-like housing, a door pivoted on one side wall and able to be locked to such housing, such door bearing on an outer side thereof game areas and a design characterizing the game, a coin unit, arranged in the housing, and provided at least with a coin inlet, with a coin tester, with a coin distribution and guiding means, with coin stack tubes and with a coin counting and paying out means, rails secured to the side wall, located on the opening side of the door, of the housing, a carriage adapted to run on such rails, a frame held by such carriage, and holding means provided on such carriage for the individual modules constituted by the components of the coin unit, characterized in that two mutually parallel rails are provided, which are provided with rows of indexing formations adapted for engagement with the teeth of two gear wheels secured to a common synchronizing shaft rotatably borne in the carriage, and said carriage having a caster bearing on an upper edge of an outer limb of the lower rail.

13. The money operated gaming machine as claimed in claim 12, characterized in that the rails possess a U-like cross section and are mounted with limbs thereof pointing toward each other and in that the rows of holes are arranged in the limbs, which face the side wall surface, of the rails.

14. The money operated gaming machine as claimed in claim 12 or claim 13, characterized by rollers rotatably carried in the carriage and fitting between the inner and outer limbs of each rail.

15. The money operated gaming machine as claimed in claim 12, or in claim 13, characterized in that the carriage is provided with two aligned projecting pins extending parallel to its outer edge, and pins being adapted to accept bearing eyes that are on the frame.

16. The money operated gaming machine as claimed in claim 12 or in claim 13, characterized in that the frame comprises a sheet metal member bent into a U-like form and having bearing eyes that are located on the outer side of the bridge part with a lateral spacing from limbs, which constitute the side parts, of the frame.

17. The money operated gaming machine as claimed in claim 9, characterized in that the carriage has a caster bearing on the upper edge of an outer limb of the lower rail.

18. The money operated gaming machine as claimed in claim 14, characterized in that the carriage is provided with two aligned projecting pins extending parallel to its outer edge, and pins being adapted to be accepted by bearing eyes that are on the frame.

19. The money operated gaming machine as claimed in claim 12, characterized in that the carriage is provided with two aligned projecting pins extending parallel to its outer edge, and pins being adapted to be accepted by bearing eyes that are on the frame.

20. The money operated gaming machine as claimed in claim 14, characterized in that the frame comprises a sheet metal member bent into a U-like form and bearing eyes that are located on the outer side of the bridge part with a lateral spacing from limbs, which constitute the side parts, of the frame.

21. The money operated gaming machine as claimed in claim 12, characterized in that the frame comprises a sheet metal member bent into a U-like form and bearing eyes that are located on the outer side of the bridge part with a lateral spacing from limbs, which constitute the side parts, of the frame.

22. The money operated gaming machine as claimed in claim 15, characterized in that the frame comprises a sheet metal member bent into a U-like form and bearing eyes that are located on the outer side of the bridge part with a lateral spacing from limbs, which constitute the side parts, of the frame.

23. A money operated gaming machine comprising a box-like housing, a door pivoted on one side wall and able to be locked to such housing, such door bearing on an outer side thereof game areas and a design characterizing the game, a coin unit, arranged in the housing, and provided at least with a coin inlet, with a coin tester, with a coin distribution and guiding means, with coin stack tubes and with a coin counting and paying out means, rails secured to the side wall, located on the opening side of the door, of the housing, a carriage adapted to run on such rails, a frame held by such carriage, and holding means provided on such carriage for the individual modules constituted by the components of the coin unit, characterized by two mutually parallel levers mounted in a pivotal manner on the side wall of the housing, such levers being provided with hooks and being pivotally connected together by a connecting link constituting a coupling member and constituting locking means for the door.

24. The money operated gaming machine as claimed in claim 23, characterized in that the articulating four membered system consisting of the two levers is urged by a spring toward the locking position.

25. The money operated gaming machine as claimed in claim 23 or claim 24, characterized in that the connecting link possesses locking members, provided with oblique surfaces, for the frame in its inserted position.

26. The money operated gaming machine as claimed in claim 23 or claim 24, characterized in that the connecting link is able to be lifted using a key and a lock operated thereby.

27. The money operated gaming machine as claimed in claim 25, characterized in that the connecting link is able to be lifted using a key and a lock operated thereby.

* * * * *